United States Patent [19]

Wilson

[11] Patent Number: 4,785,940

[45] Date of Patent: Nov. 22, 1988

[54] FLEXIBLE BAG WITH A PRESSURE SENSITIVE ADHESIVE CLOSURE STRIP

[75] Inventor: Shari J. Wilson, Minneapolis, Minn.

[73] Assignee: Minnesota Mining and Manufacturing Company, St. Paul, Minn.

[21] Appl. No.: 69,673

[22] Filed: Jul. 2, 1987

[51] Int. Cl.[4] ..... B65D 3/26; B65D 33/20

[52] U.S. Cl. ..... 206/632; 206/610; 383/84; 383/78

[58] Field of Search ..... 206/632, 610, 620; 383/84, 78, 86, 98, 99; 229/80, 73

[56] References Cited

U.S. PATENT DOCUMENTS

| | | | |
|---|---|---|---|
| 2,671,602 | 3/1954 | Vogt | 229/53 |
| 2,715,493 | 8/1955 | Vogt | 229/69 |
| 2,991,001 | 7/1961 | Hughes | 229/62 |
| 3,070,280 | 12/1962 | Richmond | 229/80 |
| 3,420,433 | 1/1969 | Bostwick | 229/80 |
| 3,613,874 | 10/1971 | Miller | 206/46 F |
| 3,915,302 | 10/1975 | Farrelly et al. | 206/460 |
| 3,942,713 | 3/1976 | Olson et al. | 229/62 |
| 3,990,627 | 11/1976 | Olson | 229/62 |
| 4,348,440 | 9/1982 | Kriozere | 383/78 |
| 4,468,811 | 8/1984 | Shaw et al. | 383/84 |
| 4,502,599 | 3/1985 | Perecman | 206/554 |
| 4,581,007 | 4/1986 | Kamp | 493/264 |

FOREIGN PATENT DOCUMENTS

| | | |
|---|---|---|
| 1354481 | 5/1974 | United Kingdom . |
| 2066208 | 7/1981 | United Kingdom . |

*Primary Examiner*—Willis Little

*Attorney, Agent, or Firm*—Donald M. Sell; James A. Smith; Leland D. Schultz

[57] ABSTRACT

A flexible bag having front and back panels sealed along bottom and side edges. A pressure sensitive adhesive closure strip is adhered to the back panel and to the rear surface of the front panel. The front panel includes a transverse separation line intermediate the bottom edge of the bag and the closure strip. A portion of the front panel above the separation line may be removed from the bag so as to expose the closure strip for securing the back panel to the front surface of the front panel for closing the top of the bag.

8 Claims, 3 Drawing Sheets

FLEXIBLE BAG WITH A PRESSURE SENSITIVE ADHESIVE CLOSURE STRIP

FIELD OF THE INVENTION

This invention relates generally to flexible plastic bags and more particularly to flexible plastic bags with pressure sensitive adhesive closure strips.

BACKGROUND OF THE INVENTION

There are many constructions of flexible bags made of plastic material and provided with some type of pressure sensitive adhesive closure strip, making the same easy and convenient to close. Some designs incorporate a removable liner applied over the closure strip prior to use. Use of such a liner represents undesirable expense compared to the cost of the material of the bag itself. U.S. Pat. Nos. 2,671,602, issued to Vogt; 2,715,493, issued to Vogt; 3,915,302, issued to Farrelly et al.; and 4,502,599, issued to Perecman all represent attempts to eliminate the need for a disposable liner by releasably adhering multiple bags sequentially together with exposed adhesive strips. A bag may be detached from the stack with the adhesive strip exposed for use in sealing the bag. However, such arrangements are not applicable to singly provided bags.

U.S. Pat. Nos. 3,942,713, issued to Olson et al.; 3,990,627, issued to Olson; and 4,581,007, issued to Kamp all relate to designs incorporating a "Z folded flap" in either the front or the rear panels of the bag to cover a closure strip of pressure sensitive adhesive prior to use. These types of arrangements, although useful, involve complicated and relatively expensive manufacturing operations in aligning the strip of pressure sensitive adhesive with the Z folded flap.

U.S. Pat. No. 3,420,433, issued to Bostwick discloses a bag with a closure strip of pressure sensitive adhesive on a front surface of the back panel of the bag. A portion of the back panel above the closure strip is folded over to cover the closure strip prior to use. This arrangement also requires additional manufacturing steps to align the folded over flap with the closure strip and to fold over the flap.

SUMMARY OF THE INVENTION

This invention provides a flexible plastic bag formed from front and back panels joined along bottom and side edges. A pressure sensitive adhesive closure strip is adhered to the back panel and includes an adhesive surface releasably adhered to the rear surface of the front panel. The pressure sensitive adhesive closure strip is secured to the back panel with a greater bond strength than the closure strip is adhered to the front panel. The front panel includes a transverse separation line intermediate the closure strip and the bottom edge of the bag. The portion of the front panel above the separation line may be removed from the bag to expose the closure strip and the back panel folded over so that the back panel may then be secured by the closure strip to the front surface of the front panel to close the top of the bag.

DETAILED DESCRIPTION OF THE INVENTION

Figure 1:
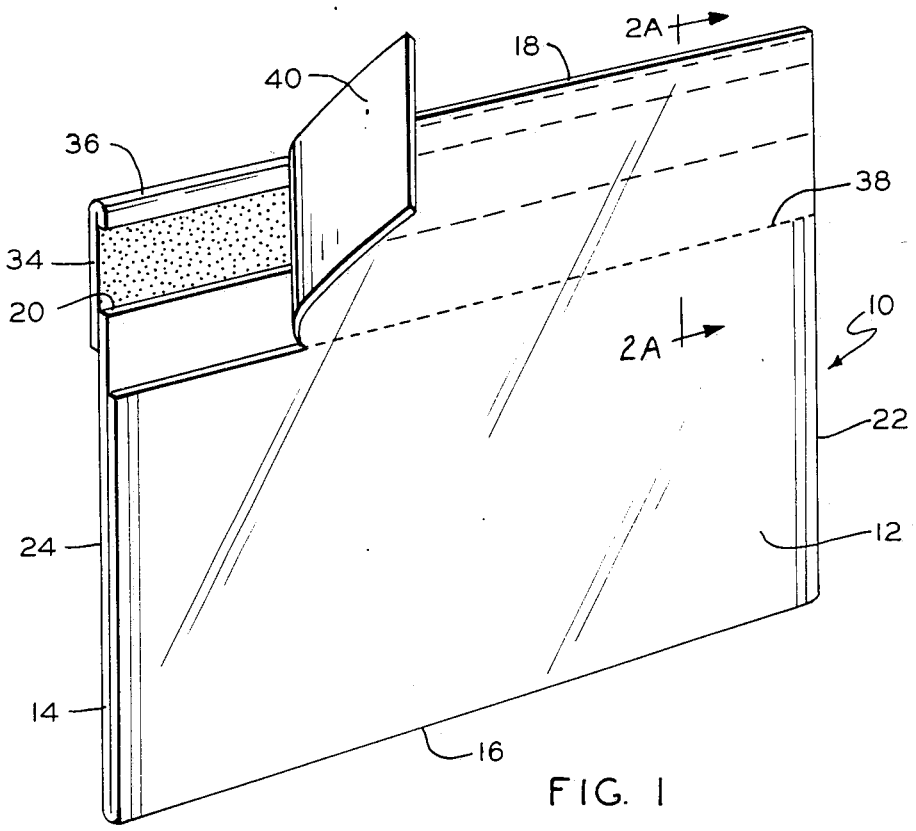
FIG. 1 is an isometric view of a flexible plastic bag constructed according to this invention.

Referring now to FIG. 1, there is shown bag 10 constructed according to the present invention. The bag may be made of any flexible plastic material found advantageous in a particular application and in particular may be constructed from any flexible polymeric material. The following non exclusive list of materials may be employed in constructing the flexible bag of this invention: low density polyethylene, polypropylene and polyester. The bag illustrated in FIG. 1 includes a single continuous sheet of the plastic material folded to form front panel 12, back panel 14, sealed bottom edge 16 and non-aligned front and rear end edges 18 and 20, respectively. The side edges 22 and 24 of the front and back panels are sealed together to form the bag. Front panel 12 includes front surface 26 and rear surface 28. Back panel 14 includes front surface 30 opposing rear surface 28 of the front panel and rear surface 32.

Figure 2A:
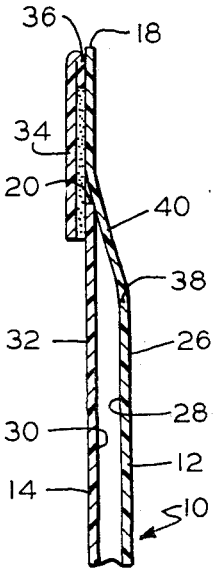
FIG. 2A is a partial cross sectional view of the bag of FIG. 1 along plane *2a—2a*.

As is also shown in FIG. 2A, a transverse closure strip 34 is constructed of single coated pressure sensitive adhesive tape. A portion of the adhesive surface of the closure strip is adhered to the rear surface 32 of the back panel. Another portion of the adhesive surface of the closure strip extends above end edge 20 of the back panel and is adhered to the rear surface 28 of the front panel below the front end edge 18. The adhesive is more securely bonded to the back panel than to the front panel. To facilitate handling of the closure strip, tab 36 is formed along the upper edge of the closure strip. Preferably, the tab 36 is formed by folding over the upper edge of the closure strip to place adjacent portions of the adhesive surface in reciprocal contact. Alternatively, the closure strip may be formed without a tab, if desired.

A separation line 38 is formed in the front panel 12 intermediate the closure strip 34 and the bottom edge 16 of the bag. The separation line may be formed by a series of perforations in the front panel, or may represent a cutting of the material of the front panel. Preferably, the separation line extends between the side edges 22 and 24 of the bag, with the portion 40 of the front panel held in place by the exposed adhesive surface of the closure strip.

Figure 2B:
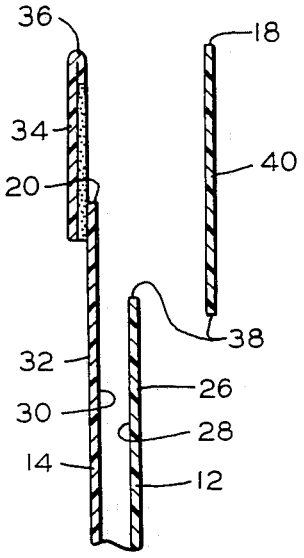
FIG. 2B is a partial cross sectional view of the bag of FIG. 2A with a portion of the front panel of the bag removed above a separation line.
Figure 2C:
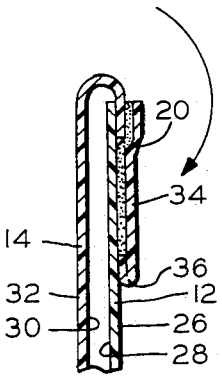
FIG. 2C is a partial cross sectional view of the bag of FIG. 2B with the back panel secured to the front panel by the closure strip mounted on the back panel.

In FIG. 2B, the portion 40 of the front panel 12 above the separation line 38 has been separated from the bag and delaminated from the closure strip 34. The delamination of the portion 40 from the closure strip 34 is facilitated by grasping the tab 36. Since the closure strip is more securely bonded to the back panel, it remains in place on the back panel after removal of the portion 40. The segment of the adhesive surface of the closure strip above the end edge 20 of the back panel is now exposed so that the top of the bag may be closed (as in FIG. 2C) by folding over the upper end edge of the back panel and securing the back panel to the front surface 26 of the front panel by the closure strip 34.

If desired, the portion 40 of the front panel may include various indicia for identification of the bag and/or its contents before and after removal of the portion 40 from the front panel for closing the bag. The flexible plastic bag thus constructed is inexpensive and does not require additional manufacturing processes or accurate alignment of the strip of adhesive with respect to the portion 40 of the front panel.

An adhesive may be selected for the closure strip that has a bond strength to the front surface 26 of the front panel that is less than the tear strength of the sheet of plastic forming the bag. This enables the bag to be opened and reclosed, if desired. Alternatively, a security deposit bag may be formed with a closure strip provided having a bond strength to the front surface of the front panel and to the back panel that is greater than the tear strength of the panels. This arrangement requires visually perceptible distortion or destruction of the bag material in order to reopen the bag. A lower strength adhesive may be employed with the front surface 26 of the front panel treated (such as by a corona treatment) to enhance the bonding of the closure strip to the front panel in either of the above embodiments.

Figure 3:
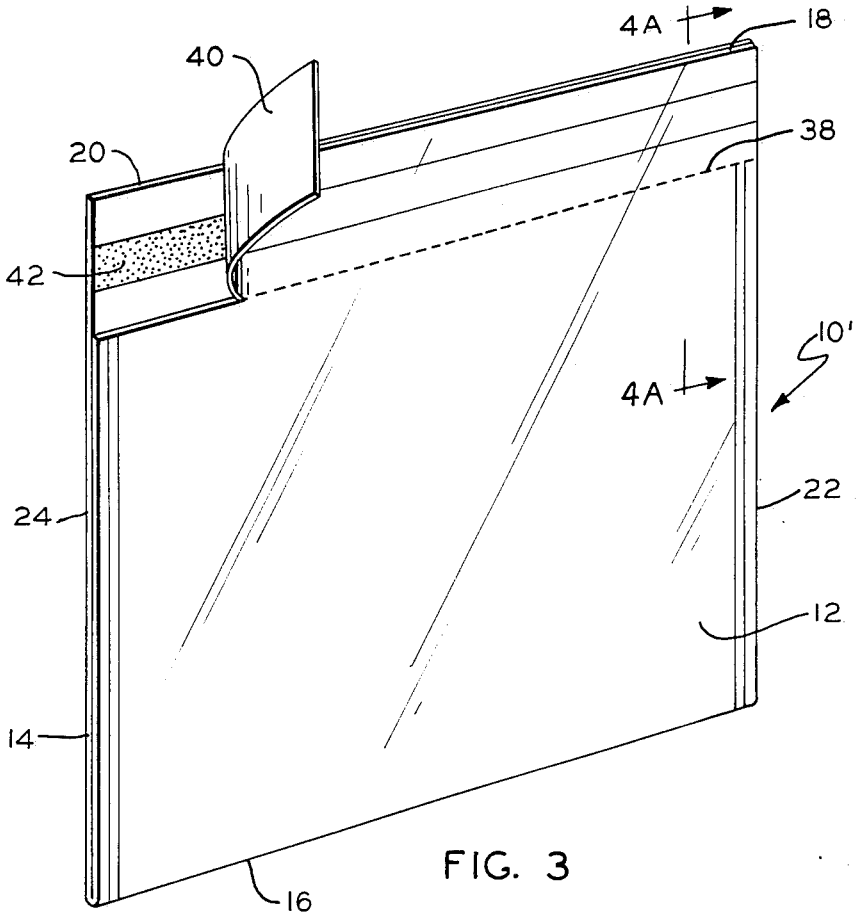
FIG. 3 is an isometric view of an alternative embodiment of the flexible plastic bag of this invention.
Figure 4A:
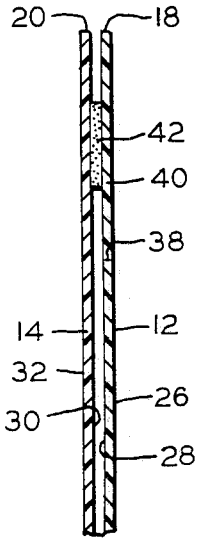
FIG. 4A is a partial cross sectional view of the bag of FIG. 3 along plane *4a—4a*.

An alternative embodiment 10' of the invention is illustrated in FIG. 3, with a bag constructed as previously described with respect to FIG. 1 and with end edge 20 of the back panel 14 extending above the separation line 38 of the front panel 12. As is also shown in FIG. 4A, a closure strip 42 of double coated pressure sensitive adhesive tape is interposed between front surface 30 of the back panel and rear surface 28 of the front panel. Alternatively, the closure strip is formed by depositing a layer of adhesive transfer tape or the like in a desired location on the back panel 14. The adhesive is bonded more securely to the back panel than it is bonded to the front panel.

Figure 4B:
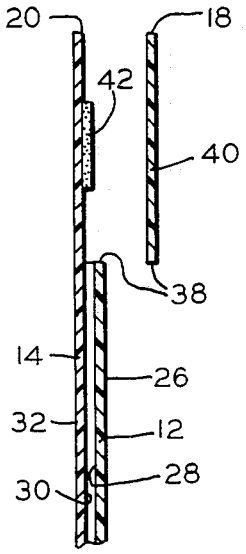
FIG. 4B is a partial cross sectional view of the bag of FIG. 4A with a portion of the front panel of the bag removed above a separation line.
Figure 4C:
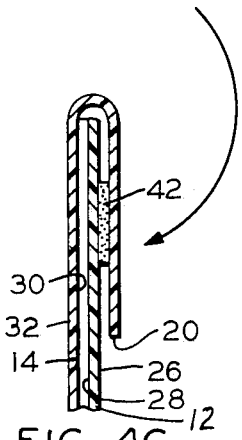
FIG. 4C is a partial cross sectional view of the bag of FIG. 4B with the back panel secured to the front panel by the closure strip mounted on the back panel.

In FIG. 4B, the portion 40 of the front panel 12 above the separation line 38 has been separated from the bag, delaminated from the closure strip 42 and removed. Since the closure strip 42 is more securely bonded to the back panel, it remains in place on the back panel after removal of the portion 40. The entire adhesive surface of the closure strip is now exposed so that the top of the bag may be closed (as in FIG. 4C) by folding over the upper end edge of the back panel and securing the back panel to the front surface 26 of the front panel by the closure strip 42.

Figure 5:
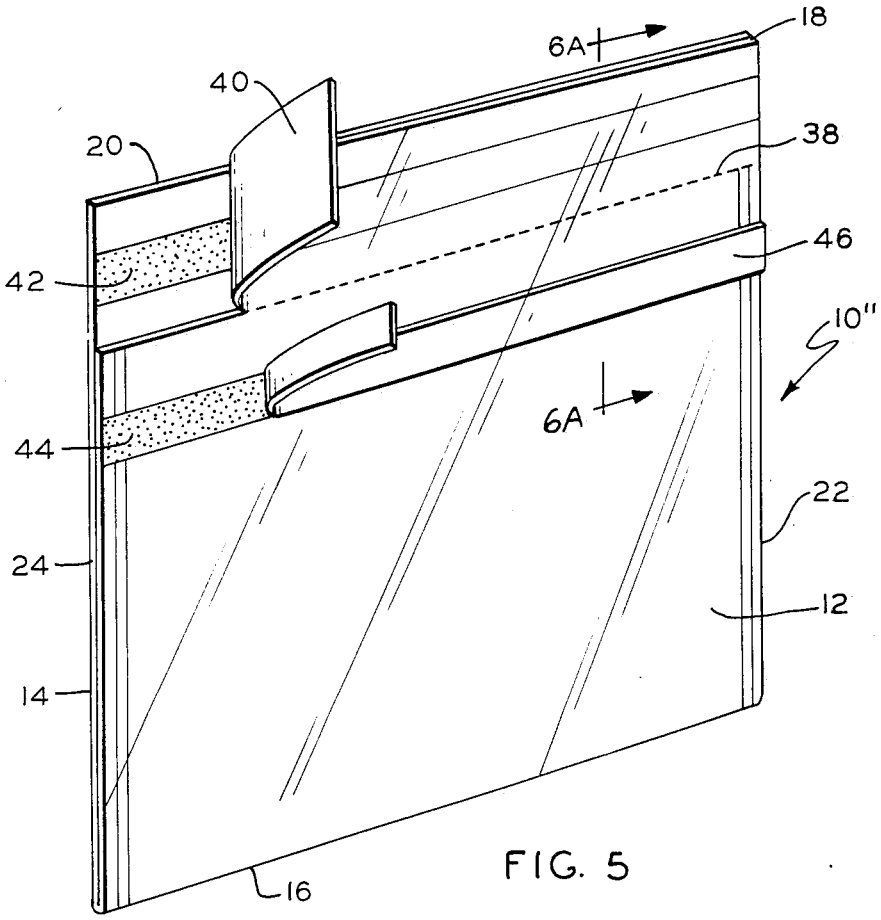
FIG. 5 is an isometric view of yet another alternative embodiment of a flexible plastic bag constructed according to this invention.
Figure 6A:
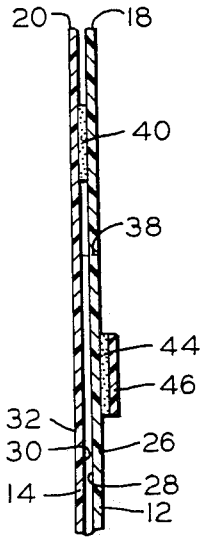
FIG. 6A is a partial cross sectional view of the bag of FIG. 5 along plane *6a—6a*.

Another alternative embodiment 10'' of the invention is shown in FIGS. 5 and 6A and includes a bag constructed as in FIG. 3. The bag 10'' includes a second closure strip 44 of pressure sensitive adhesive to the front surface 26 of the front panel 12 of the bag shown in FIG. 3. A removable liner 46 is applied to the second closure strip 44 prior to use. Security deposit bags exist that include a pair of pressure sensitive adhesive tape strips. The liners of both strips may be removed and the adhesive tape strips pressed together to form a mutual bond that is stronger than the tear strength of the plastic bag. In the embodiment of the invention shown in FIGS. 5 and 6a, the removable liner of the closure strip mounted on the back panel has been replaced by the portion 40 of the front panel.

Figure 6B:
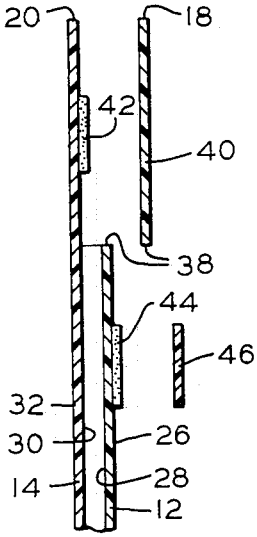
FIG. 6B is a partial cross sectional view of the bag of FIG. 6A with a portion of the front panel of the bag removed above a separation line and a liner removed from a second pressure sensitive adhesive closure strip on the front surface of the front panel of the bag.
Figure 6C:
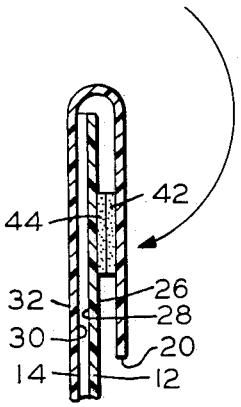
FIG. 6C is a partial cross sectional view of the bag of FIG. 6B with the back panel secured to the front panel by the first and second closure strips.

The portion 40 of the front panel may be removed at the separation line as shown in FIG. 6B and the liner 46 of the second closure strip removed. The back panel is then folded over, as in FIG. 6C to place the first and second closure strips together to close the top of the bag. A bag could also be constructed with two closure strips, with one of the closure strips mounted on the rear surface of the back panel as in FIG. 1. In all other respects, this embodiment of the invention is as herein described.

The following are examples of flexible plastic bags constructed according to this invention:

EXAMPLE 1

A bag was constructed as in FIG. 1 from 0.00125" low density polyethylene film manufactured by Deerfield Plastics Co., Inc. of South Deerfield, Ma. A closure strip of Scotch brand #600 pressure sensitive adhesive tape manufactured by Minnesota Mining and Manufacturing Co. of St. Paul, Minn. was adhered to the back panel, with an exposed portion of the adhesive surface adhered to the rear surface of the front panel. The closure strip was removable from the front surface of the front panel without damage, enabling reclosing of the bag.

EXAMPLE 2

A bag was constructed as in FIG. 1 from 0.001" D135 Brand polymeric film manufactured by W.R. Grace Co. of Duncan, S.C. A closure strip of Scotch brand #600 pressure sensitive adhesive tape manufactured by Minnesota Mining and Manufacturing Co. of St. Paul, Minn. was adhered to the back panel, with an exposed portion of the adhesive surface adhered to the rear surface of the front panel. The closure strip was removable from the front surface of the front panel without damage enabling reclosing of the bag.

EXAMPLE 3

A bag was constructed as in FIG. 1 from 0.00125" low density polyethylene film manufactured by Exxon Chemicals Americas Corp. of Houston, Tex. A closure strip of Scotch brand #600 pressure sensitive adhesive tape manufactured by Minnesota Mining and Manufacturing Co. of St. Paul, Minn. was adhered to the back panel, with an exposed portion of the adhesive surface adhered to the rear surface of the front panel. The closure strip was removable from the front surface of the front panel without damage, enabling reclosing of the bag.

EXAMPLE 4

A bag was constructed as in FIG. 5 from 0.0025" low density polyethylene film manufactured by Stone Container Co. of Roseville, Minn. and marketed under the brand name S4E. A first closure strip of Scotch brand #600 pressure sensitive adhesive tape manufactured by Minnesota Mining and Manufacturing Co. of St. Paul, Minn. was adhered to the back panel, with an exposed portion of the adhesive surface adhered to the rear surface of the front panel. A second closure strip of Scotch brand #444 pressure sensitive adhesive tape manufactured by Minnesota Mining and Manufacturing Co. of St. Paul, Minn. was applied to the front surface of the front panel and included a removable liner. The first and second closure strips were secured together with a bond strength greater than the tear strength of the plastic film to form a security deposit bag.

What is claimed is:

1. A bag comprising:

(a) a back panel having a front and rear surface, a front panel having a front and a rear surface, said back panel and said front panel being joined to form the bottom and sides of the bag;

(b) a pressure sensitive adhesive closure strip adhered to said back panel and to said rear surface of said front panel, said closure strip having a bond strength to said back panel greater than the bond strength of said closure strip to said rear surface of said front panel; and (c) said front panel including a transverse separation line intermediate said closure strip and said bottom edge of the bag, whereby said front panel may be divided at said separation line and a portion of said front panel above the separation line removed from the bag to expose said closure strip for adhesively securing said back panel to said front surface of said front panel to close the top of the bag.

2. The bag of claim 1, wherein said closure strip is adhered to said rear surface of said back panel, with a portion of said closure strip extending above said end edge of said back panel so as to be releasably adhered to said rear surface of said front panel above said separation line.

3. The bag of claim 1, wherein said closure strip is interposed between said front surface of said back panel and said rear surface of said front panel above said separation line.

4. The bag of claim 1, wherein the bond strength of said closure strip to said back panel and to said front surface of said front panel is greater than the tear strength of said front and said rear panels.

5. The bag of claim 1, further comprising a second pressure sensitive adhesive closure strip adhered to said front surface of said front panel and including a removable liner, for adhesive contact with said first closure strip with said liner removed so as to secure said back panel to said front panel.

6. The bag of claim 1, wherein said front surface of said front panel is treated to increase the bond strength of said closure strip to said front surface of said front panel.

7. The bag of claim 1, wherein said bond strength of said closure strip to said front surface of said front panel is less than the tear strength of said front panel enabling the bag to be reopened without damage to the bag.

8. The bag of claim 1, further comprising indicia on the portion of said front panel above said separation line.

* * * * *